US010450519B2

(12) United States Patent
Yang et al.

(10) Patent No.: US 10,450,519 B2
(45) Date of Patent: Oct. 22, 2019

(54) METHOD FOR HYDROFINING OF MIDDLE DISTILLATES OF FISCHER-TROPSCH SYNTHETIC FULL-RANGE DISTILLATES

(71) Applicant: WUHAN KAIDI ENGINEERING TECHNOLOGY RESEARCH INSTITUTE CO., LTD., Wuhan (CN)

(72) Inventors: Weiguang Yang, Wuhan (CN); Youliang Shi, Wuhan (CN)

(73) Assignee: WUHAN KAIDI ENGINEERING TECHNOLOGY RESEARCH INSTITUTE CO., LTD., Wuhan (CN)

( * ) Notice: Subject to any disclaimer, the term of this patent is extended or adjusted under 35 U.S.C. 154(b) by 0 days.

(21) Appl. No.: 15/693,467

(22) Filed: Aug. 31, 2017

(65) Prior Publication Data

US 2017/0362517 A1 Dec. 21, 2017

Related U.S. Application Data

(63) Continuation-in-part of application No. PCT/CN2016/074629, filed on Feb. 26, 2016.

(30) Foreign Application Priority Data

Mar. 2, 2015 (CN) ..... 2015 1 0095153

(51) Int. Cl.
*C10G 65/04* (2006.01)
*C10G 67/02* (2006.01)
(Continued)

(52) U.S. Cl.
CPC ..... *C10G 67/02* (2013.01); *C10G 45/02* (2013.01); *C10G 45/72* (2013.01); *C10G 65/04* (2013.01);
(Continued)

(58) Field of Classification Search
CPC ..... C10G 67/02; C10G 65/04; C10G 45/02; C10G 45/72; C10G 2300/301; C10G 2300/1022
See application file for complete search history.

(56) References Cited

U.S. PATENT DOCUMENTS 3,728,249 A * 4/1973 Antezana et al. ..... B01J 8/0453 208/143

FOREIGN PATENT DOCUMENTS

CN 102746895 * 10/2012

* cited by examiner

*Primary Examiner* — Randy Boyer
*Assistant Examiner* — Juan C Valencia
(74) *Attorney, Agent, or Firm* — Matthias Scholl P.C.; Matthias Scholl

(57) ABSTRACT

A method for hydrofining of middle distillates of Fischer-Tropsch synthetic full-range distillates, the method including: 1) separating middle distillates of Fischer-Tropsch synthetic full-range distillates to yield light distillates, heavy distillates and intermediate distillates; 2) metering the light distillates, the heavy distillates and the intermediate distillates; providing a hydrogenation reactor filled with a hydrofining catalyst and including a first feed inlet, a second feed inlet and a third feed inlet from the top down; mixing hydrogen and the light distillates, the heavy distillates and the intermediate distillates, respectively, and introducing resulting mixtures to the hydrogenation reactor via the first feed inlet, the second feed inlet and the third feed inlet, respectively; and 3) introducing products from 2) to a gas-liquid separator to yield hydrogen and liquid products, returning the hydrogen to the hydrogenation reactor, and introducing the liquid products to a fractionating column for further separation.

4 Claims, 1 Drawing Sheet

(51) Int. Cl.
*C10G 45/02* (2006.01)
*C10G 45/72* (2006.01)

(52) U.S. Cl.
CPC ..... *C10G 2300/1022* (2013.01); *C10G 2300/301* (2013.01)

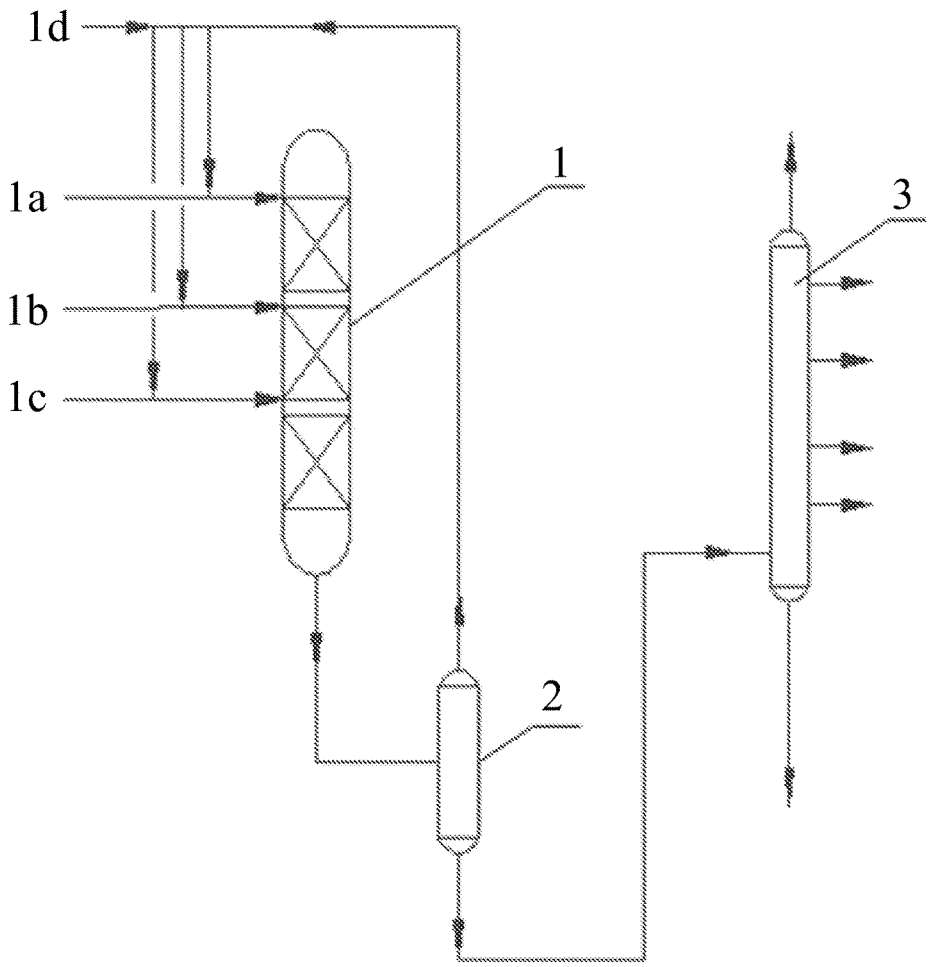
1d
1a
1b
1c
1
2
3

METHOD FOR HYDROFINING OF MIDDLE DISTILLATES OF FISCHER-TROPSCH SYNTHETIC FULL-RANGE DISTILLATES

CROSS-REFERENCE TO RELATED APPLICATIONS

This application is a continuation-in-part of International Patent Application No. PCT/CN2016/074629 with an international filing date of Feb. 26, 2016, designating the United States, now pending, and further claims foreign priority to Chinese Patent Application No. 201510095153.3 filed Mar. 2, 2015. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The invention relates to a method for hydrofining of middle distillates of Fischer-Tropsch synthetic full-range distillates.

Description of the Related Art

Low-temperature Fischer-Tropsch synthetic products are mainly $C_{4-70}$ hydrocarbons and oxygenated compounds, which can be hydrocracked to yield liquid fuels and chemicals.

Conventionally, the Fischer-Tropsch synthetic products are cracked directly. However, direct cracking reduces the stability and service life of catalysts and produces inferior products.

Although hydrocracking methods have been developed, the middle distillates stay in the hydrogenation reactor for a relatively long time, leading to secondary cracking. In addition, hydrocracking releases a relatively large amount of heat, increasing difficulty to control temperature, causing the formation of coking.

SUMMARY OF THE INVENTION

In view of the above-described problems, it is one objective of the invention to provide a method for hydrofining of middle distillates of Fischer-Tropsch synthetic full-range distillates. Using the method, the stability and service life of the catalysts are maintained, the reaction temperature is easy to control, and the resulting products are highly qualified.

To achieve the above objective, in accordance with one embodiment of the invention, there is provided a method for hydrofining of middle distillates of Fischer-Tropsch synthetic full-range distillates, the method comprising:

1) separating middle distillates of Fischer-Tropsch synthetic full-range distillates to yield light distillates, heavy distillates and intermediate distillates;
2) metering using a metering pump the light distillates, the heavy distillates and the intermediate distillates; providing a hydrogenation reactor filled with a hydrofining catalyst and comprising a first feed inlet, a second feed inlet and a third feed inlet from the top down, each feed inlet communicating with a hydrogen inlet; mixing hydrogen and the light distillates, the heavy distillates and the intermediate distillates, respectively, and introducing resulting mixtures to the hydrogenation reactor via the first feed inlet, the second feed inlet and the third feed inlet, respectively; a reaction pressure in the hydrogenation reactor being between 4 MPa and 8 MPa, a ratio of the hydrogen to distillates being between 100:1 and 2000:1, a liquid hourly space velocity being between 0.1 $h^{-1}$ and 5.0 $h^{-1}$, and a reaction temperature being between 300° C. and 420° C.; and
3) introducing products from 2) to a gas-liquid separator to yield hydrogen and liquid products, returning the hydrogen to the hydrogenation reactor via the first feed inlet, the second feed inlet and the third feed inlet, respectively, to mix with the light distillates, the heavy distillates and the intermediate distillates, and introducing the liquid products to a fractionating column for further separation.

In a class of this embodiment, in 2), the reaction pressure in the hydrogenation reactor is between 5 MPa and 7.5 MPa, the ratio of the hydrogen to distillates is between 700:1 and 1200:1, the liquid hourly space velocity is between 0.5 $h^{-1}$ and 2.0 $h^{-1}$, and the reaction temperature is between 320° C. and 400° C.

In a class of this embodiment, the first feed inlet is disposed on the top of the hydrogenation reactor, assume the hydrogenation reactor is H in height, the second feed inlet is disposed on between ⅓H and ½H of the hydrogenation reactor from top to bottom, and the third feed inlet is disposed below the second feed inlet by ⅙H and ⅓H of the hydrogenation reactor.

In a class of this embodiment, in 1), a boiling range of the light distillates is lower than 180° C.; a boiling range of the intermediate distillates is between 180° C. and 360° C.; and a boiling range of the heavy distillates is greater than 360° C.

In a class of this embodiment, in 1), a boiling range of the light distillates is lower than 150° C.; a boiling range of the intermediate distillates is between 180° C. and 350° C.; and a boiling range of the heavy distillates is greater than 350° C.

Advantages of the method for hydrofining of middle distillates of Fischer-Tropsch synthetic full-range distillates in accordance with embodiments of the invention are as follows: the light, intermediate and heavy distillates are fed through three different inlets, which guarantees the stable control of the temperature in the hydrofining reaction bed, reduces the feeding temperature of the heavy distillates in the middle and top parts, saving the energy consumption. Meanwhile, the intermediate distillates are added via the middle part of the hydrogenation reactor, shortening the stay time of the intermediate distillates in the reactor bed, preventing the secondary cracking of the light distillates, and improving the quality of the distillate products.

BRIEF DESCRIPTION OF THE DRAWINGS

The invention is described hereinbelow with reference to accompanying drawings, in which the sole FIGURE is a flow chart of a method for hydrofining of middle distillates of Fischer-Tropsch synthetic full-range distillates in accordance with one embodiment of the invention.

DETAILED DESCRIPTION OF THE EMBODIMENTS

For further illustrating the invention, experiments detailing a method for hydrofining of middle distillates of Fischer-Tropsch synthetic full-range distillates are described below. It should be noted that the following examples are intended to describe and not to limit the invention.

As shown in the sole FIGURE, the method for hydrofining of middle distillates of Fischer-Tropsch synthetic full-range distillates comprises the following steps:

1) separating middle distillates of Fischer-Tropsch synthetic full-range distillates to yield light distillates, heavy distillates and intermediate distillates;
2) metering using a metering pump the light distillates, the heavy distillates and the intermediate distillates; providing a hydrogenation reactor 1 filled with a hydrofining catalyst and comprising a first feed inlet 1*a*, a second feed inlet 1*b* and a third feed inlet 1*c* from the top down, each feed inlet communicating with a hydrogen inlet; mixing hydrogen and the light distillates, the heavy distillates and the intermediate distillates, respectively, and introducing resulting mixtures to the hydrogenation reactor via the first feed inlet 1*a*, the second feed inlet 1*b* and the third feed inlet 1*c*, respectively; a reaction pressure in the hydrogenation reactor being between 4 MPa and 8 MPa, a ratio of the hydrogen to distillates being between 100:1 and 2000:1, a liquid hourly space velocity being between 0.1 $h^{-1}$ and 5.0 $h^{-1}$, and a reaction temperature being between 300° C. and 420° C.; and
3) introducing products from 2) to a gas-liquid separator 2 to yield hydrogen and liquid products, returning the hydrogen to the hydrogenation reactor via the first feed inlet 1*a*, the second feed inlet 1*b* and the third feed inlet 1*c*, respectively, to mix with the light distillates, the heavy distillates and the intermediate distillates, and introducing the liquid products to a fractionating column 3 for further separation.

Preferably, in 2), the reaction pressure in the hydrogenation reactor is between 5 MPa and 7.5 MPa, a ratio of the hydrogen to distillates is between 700:1 and 1200:1, a liquid hourly space velocity is between 0.5 $h^{-1}$ and 2.0 $h^{-1}$, and a reaction temperature is between 320° C. and 400° C.

The positions of the first feed inlet 1*a*, the second feed inlet 1*b* and the third feed inlet 1*c* on the hydrogenation reactor 1 are as follows: the first feed inlet is disposed on the top of the hydrogenation reactor 1, assume the hydrogenation reactor 1 is H in height, the second feed inlet is disposed on between ⅓H and ½H of the hydrogenation reactor from top to bottom, and the third feed inlet is disposed below the second feed inlet by ⅙H and ⅓H of the hydrogenation reactor.

In 1), the middle distillates of the full-range low-temperature Fischer-Tropsch synthetic distillates are divided into light distillates, heavy distillates and intermediate distillates; and the light distillates, the heavy distillates and the intermediate distillates can be mixed in any ratio.

Specifically, in 1), the boiling range of the light distillates is lower than 180° C.; the boiling range of the intermediate distillates is between 180° C. and 360° C.; and the boiling range of the heavy distillates is greater than 360° C. Optionally, in 1), the boiling range of the light distillates is lower than 180° C.; the boiling range of the intermediate distillates is between 180° C. and 360° C.; and the boiling range of the heavy distillates is greater than 360° C.

The hydrorefining catalysts adopted by the invention employ existing commercial catalysts such as FF-14, FF-24, 3936, FF-16, FF-26, FF-36 and FF-46 hydrorefining catalysts developed by Fushun Research Institute of Petroleum and Petrochemicals, and can also be prepared according to the general knowledge in the art.

Advantages of the method for hydrofining of middle distillates of Fischer-Tropsch synthetic full-range distillates of the invention are as follows:

1. The unsaturated alkenes and oxygenated compounds of Fischer-Tropsch synthesis are mainly in the light distillates; and the hydrofining of light distillates produce a lot of heat. The heavy distillates which enter the reactor through upper middle part can attenuate a large amount of reaction heat produced by hydrofining of the light distillates which enter the reactor through top to make the temperature rise more controllable, effectively reduce the bed temperature rise, extend the catalyst life and make operation smooth; and at the same time, the heavy distillates can also be heated to make the heavy distillates reach the reaction temperature and reduce energy consumption.

2. The intermediate distillates enter the reactor through middle part so the intermediate distillates stay in the reactor for a shorter time. Therefore, the intermediate distillates can avoid excessive cracking better so as to provide a guarantee for producing intermediate distillates.

3. The method of the invention for hydrofining of full-range low-temperature Fischer-Tropsch synthetic distillates adopts a single reactor for hydrofining of Fischer-Tropsch synthetic products, simplifies the process flow, reduces investment in equipment and lowers energy consumption.

In order to further illustrate the key points, effects and advantages of the invention, the following embodiments and comparison examples are adopted for further illustration. However, the invention is not limited to the following embodiments and comparison examples.

The method takes full-range Fischer-Tropsch synthetic distillates as raw materials, and uses a homemade fixed bed reactor with an interior diameter of 2 cm. The first, second and third feed inlets are respectively arranged on the top, at ⅓H and at ½H. The reactor is filled with a 30 mL conventional hydrofining catalyst made in the laboratory. Full-range Fischer-Tropsch synthetic distillates whose boiling range is lower than 180° C. are light distillates; the Fischer-Tropsch synthetic distillates whose boiling range is between 180° C. and 360° C. are intermediate distillates; and the Fischer-Tropsch synthetic distillates whose boiling range is greater than 360° C. are heavy distillates. After being measured by a metering pump, the light distillates, the heavy distillates and the intermediate distillates enter the hydrogenation reactor respectively. Examples 1-5 are the test situations of the light, intermediate and heavy distillates of the Fischer-Tropsch synthetic distillates with different ratios in the reactor. Comparison Examples 1 and 2 show the situation that the light, intermediate and heavy distillates mix in different ratios and then enter the reactor through the upper inlet. Table 1 shows the reaction conditions and index parameters in Examples 1-5 and Comparison Examples 1 and 2.

TABLE 1

| Items | Example 1 | Example 2 | Example 3 | Example 4 | Example 5 | Comparison Example 1 | Comparison Example 2 |
|---|---|---|---|---|---|---|---|
| Ratio of light distillates to heavy distillates to intermediate distillates | 3:2:5 | 5:3:2 | 2:6:2 | 6:2:2 | 2:2:6 | 5:3:2 | 2:6:2 |

TABLE 1-continued

| Items | Example 1 | Example 2 | Example 3 | Example 4 | Example 5 | Comparison Example 1 | Comparison Example 2 |
|---|---|---|---|---|---|---|---|
| Reaction pressure MPa | 7 | 7 | 7 | 4.5 | 8 | 7 | 7 |
| Average hydrofining temperature ° C. | 328 | 330 | 324 | 331 | 325 | 355 | 334 |
| Liquid hourly space velocity | 0.8 | 0.8 | 0.8 | 0.5 | 1.0 | 0.8 | 0.8 |
| Ratio of hydrogen to oil | 800 | 1000 | 800 | 500 | 1200 | 800 | 1000 |
| Bed temperature difference | 19° C. | 22° C. | 14° C. | 24° C. | 16° C. | 28° C. | 20° C. |

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for hydrofining of middle distillates of Fischer-Tropsch synthetic full-range distillates, the method comprising:

1) separating middle distillates of Fischer-Tropsch synthetic full-range distillates to yield light distillates, heavy distillates, and intermediate distillates; wherein a boiling range of the light distillates lies below 180° C.; a boiling range of the intermediate distillates is between 180° C. and 360° C.; and a boiling range of the heavy distillates lies above 360° C.;

2) metering using a metering pump the light distillates, the heavy distillates, and the intermediate distillates; providing a hydrogenation reactor filled with a hydrofining catalyst and comprising a first feed inlet, a second feed inlet, and a third feed inlet from the top down, wherein each of the first feed inlet, the second feed inlet, and the third feed inlet communicates with a hydrogen inlet, a height of the hydrogenation reactor is represented by H, the first feed inlet is disposed on a top of the hydrogenation reactor, the second feed inlet is disposed on the hydrogenation reactor at a height between ⅓ H and ½ H as measured from the top of the hydrogenation reactor, and the third feed inlet is disposed below the second feed inlet at a height between ⅙ H and ⅓ H as measured from the second feed inlet; introducing the light distillates and hydrogen into the hydrogenation reactor via the first feed inlet, introducing the heavy distillates and hydrogen into the hydrogenation reactor via the second feed inlet, and introducing the intermediate distillates and hydrogen into the hydrogenation reactor via the third feed inlet; a reaction pressure in the hydrogenation reactor being between 4 MPa and 8 MPa, a ratio of the hydrogen to distillates being between 100:1 and 2000:1, a liquid hourly space velocity being between 0.1 $h^{-1}$ and 5.0 $h^{-1}$, and a reaction temperature being between 300° C. and 420° C.; and 3) introducing products from 2) to a gas-liquid separator to yield hydrogen and liquid products, returning the hydrogen to the hydrogenation reactor via the first feed inlet, the second feed inlet, and the third feed inlet, respectively, to mix with the light distillates, the heavy distillates, and the intermediate distillates, and introducing the liquid products to a fractionating column for further separation.

2. The method of claim 1, wherein in 2), the reaction pressure in the hydrogenation reactor is between 5 MPa and 7.5 MPa, the ratio of the hydrogen to distillates is between 700:1 and 1200:1, the liquid hourly space velocity is between 0.5 $h^{-1}$ and 2.0 $h^{-1}$, and the reaction temperature is between 320° C. and 400° C.

3. The method of claim 1, wherein in 1), a boiling range of the light distillates lies below 150° C.; a boiling range of the intermediate distillates is between 180° C. and 350° C.; and a boiling range of the heavy distillates is lies above 360° C.

4. The method of claim 2, wherein in 1), a boiling range of the light distillates lies below 150° C.; a boiling range of the intermediate distillates is between 180° C. and 350° C.; and a boiling range of the heavy distillates lies above 360° C.

* * * * *